US005201515A

United States Patent [19]

Funk

[11] Patent Number: 5,201,515

[45] Date of Patent: Apr. 13, 1993

[54] DEVICE FOR DEPOSITING AND ALIGNING SHEETS INDIVIDUALLY SUPPLIED TO A STACK

[75] Inventor: Helmut Funk, Remshalden, Fed. Rep. of Germany

[73] Assignee: Eastman Kodak Company, Rochester, N.Y.

[21] Appl. No.: 834,956

[22] Filed: Feb. 14, 1992

[30] Foreign Application Priority Data

May 24, 1991 [DE] Fed. Rep. of Germany ..... 4116991

[51] Int. Cl.[5] ..... B65H 31/34

[52] U.S. Cl. ..... 271/224; 271/236; 271/251

[58] Field of Search ..... 271/236, 245, 251, 220, 271/224

[56] References Cited

U.S. PATENT DOCUMENTS 4,179,117 12/1979 Rhodes ..... 271/251
4,257,587 3/1981 Smith ..... 271/251 X
5,013,021 5/1991 Johdai ..... 271/220 X

FOREIGN PATENT DOCUMENTS 3724713 3/1988 Fed. Rep. of Germany ..... 271/251
3941477 6/1991 Fed. Rep. of Germany .

*Primary Examiner*—Richard A. Schacher
*Attorney, Agent, or Firm*—Lawrence P. Kessler

[57] ABSTRACT

In a collecting tray (1) having a lateral limiting member (6) and an end-side abutment (3), a driven aligning wheel (16) is arranged on a pivotally mounted, spring-biased tube (9 and 10 respectively). The abutment (3) is pivotally mounted on an arm (3*a*) and connected with a lever (4) which includes a pin (4*a*) adapted to support tube (9). When abutment (3) is pivoted to its opening position, aligning wheel (16) is lifted off sheet stack (24) so that the stack can be removed unimpededly. The aligning wheel (16) is conically shaped and pivotable from a position in which it is spring-biased towards the lateral limiting member (6) to a position directed at the front abutment (3) such that when a sheet has been laterally aligned, aligning wheel (16) is caused by the increasing friction to pivot in opposition to its spring bias to the position direction at the front abutment (3). The peripheral surface (16*a*) of the conical aligning wheel (16) is disposed such that an incoming sheet (7) first contacts the smaller diameter thereof and, sliding along the surface, is guided below aligning wheel (16).

13 Claims, 5 Drawing Sheets

DEVICE FOR DEPOSITING AND ALIGNING SHEETS INDIVIDUALLY SUPPLIED TO A STACK

BACKGROUND OF THE INVENTION

The present invention relates in general to a device for aligning sheets which are individually supplied to, and stacked in a collecting tray having a stacking surface and a lateral limiting member extending parallel with the sheet entrance direction as well as an abutment associated with the front end sides of the sheets, such device including a drivable aligning wheel which rests on the incoming sheet and aligns sheets with both the lateral limiting member and the front abutment.

In a device such as disclosed in patent application P 39 41 477.9, a screw wheel is provided by which the sheets when moving under the action of gravity onto a stacking surface of a collecting tray, downwardly inclined in the sheet entrance direction, are aligned with a lateral limiting member and a movable end-side abutment. In the area of the sheet edges to be aligned, a stapling unit is arranged which staples a predetermined number of sheets. The stapled sheet stack is released when the movable abutment is pivoted to its opening position so that the stack can slide out of the collecting tray under the action of gravity and can be fed to a depositing tray. Since the continuously rotating screw wheel rests constantly on the upper surface of the stack, it exerts pressure on the sheet stack in a direction transverse to the release direction so that the stack is moved into an undesired oblique position and cannot be deposited in an orderly manner.

It is known that an axially symmetrical aligning wheel can be used instead of a screw wheel. However, such aligning wheels involve the danger of an incoming sheet impinging linearly and slipping over the aligning wheel so that it cannot be aligned.

SUMMARY OF THE INVENTION

This invention is directed to an aligning device wherein the sheet stack accumulated can be removed from the collecting tray without any difficulty. Further, the sheets can be guided in a simple and reliable manner into the range of action of the aligning wheel.

According to the invention, an abutment can be moved out of the transport path of the sheet stack, an aligning wheel can be lifted off the sheet stack, the abutment and the aligning wheel being positively coupled such that when the abutment is moved out of the transport path of the sheet stack, the aligning wheel is also lifted off said sheet stack. The aligning wheel is conically shaped and has a diameter which increases from the lateral limiting member towards the center of the sheet, and the peripheral conical surface of the aligning wheel serves as a guiding surface and is arranged at an angle to the sheet entrance direction such that the smaller diameter of the aligning wheel is disposed next to said incoming sheet.

Advantageously, the aligning wheel according to the invention is mounted on a pivotal support which allows the aligning wheel to pivot automatically from an initial operative direction in which it points to the lateral limiting member to an operative direction in which it points towards the end-side abutment, as soon as the sheet has reached its laterally aligned end position. In a particular embodiment of this invention, the support includes a first stationary component to which a first tube is attached. A second component is pivotally mounted on the first component and a second tube is attached to the second component, the second tube being aligned with said first tube. The aligning wheel is mounted on the second tube for rotation. Advantageously, a spring wire serving as a flexible shaft is guided within the tubes, the spring wire positively engaging with its two ends the aligning wheel and a driving portion respectively. The spring wire is in some areas designed as a helical tension spring which serves for length compensation, and as a resetting spring for the aligning wheel which can be moved to different operative positions. The tube is secured to a pivotable, stationarily mounted holder and supported by a pin which is connected, via a lever, with a pivotable arm which comprises the front abutment. Advantageously the stacking surface of the collecting tray is downwardly inclined to the sheet entrance direction so that the sheets can be automatically transported under the action of gravity. The stacking surface of the collecting tray is provided with a surface which extends parallel with the front abutment and is lower than the stacking surface and which serves to deform and thus stabilize the end-side area of the sheet.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE PREFERRED EMBODIMENTS

Figure 1:
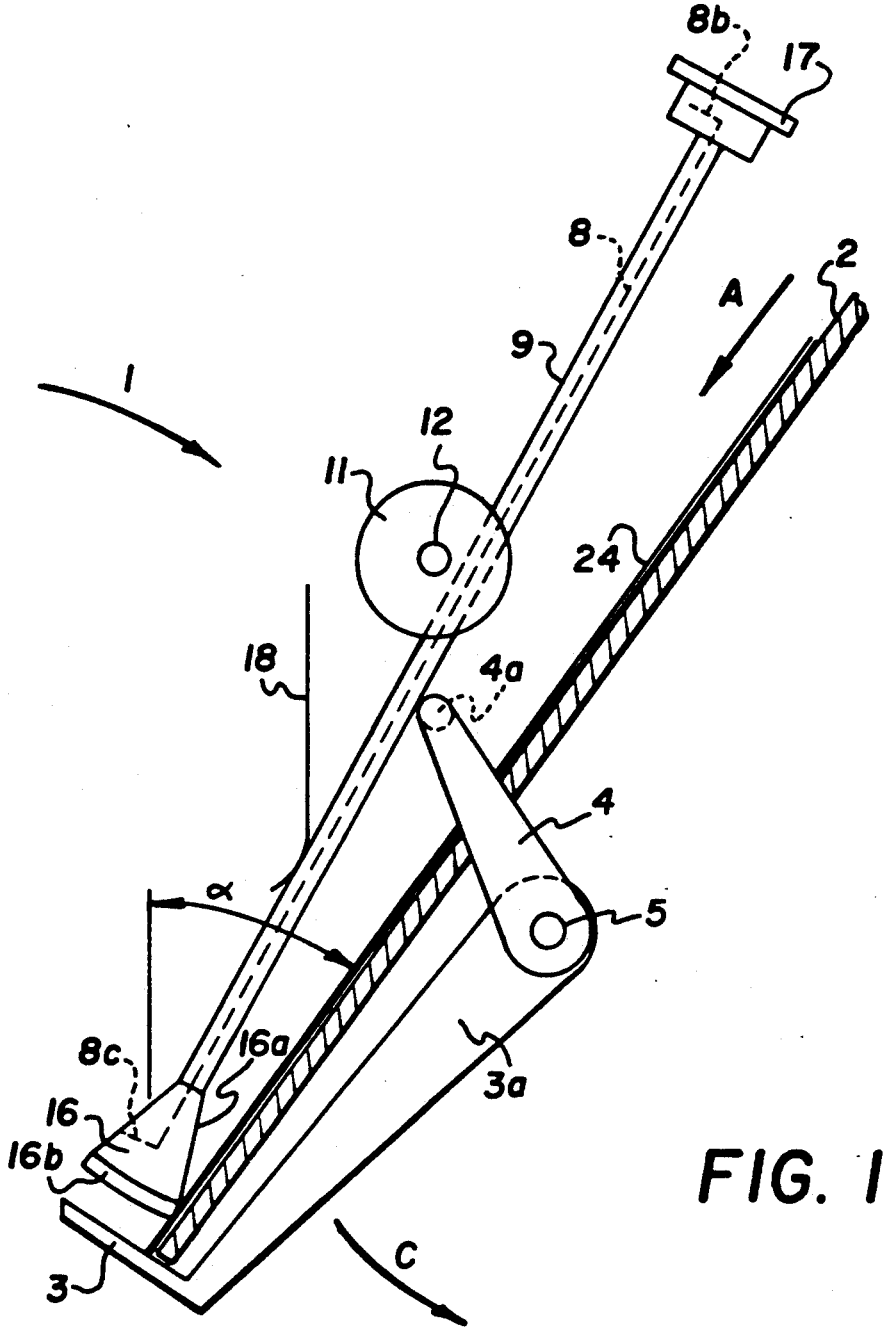
FIG. 1 is a lateral, partially sectional view of the device according to this invention.

The sheet-aligning device according to the invention is arranged in a known type of finisher (not illustrated) in which sheets individually supplied, in particular copy sheets produced by a copier, are collected in a collecting tray 1 and stapled in sets by means of a stapling unit 19. Of the finisher which is connected to a copier (not shown) only those components are illustrated as are necessary to understand the invention.

In the collecting tray 1 which is inclined to the sheet entrance direction and whose stacking surface 2 is disposed at an angle $\alpha$ of, for example, less than 45° to the vertical plane, sheets 7 entering in the direction of the arrow "A" are deposited one on top of the other to form a sheet stack 24. During feeding the individual sheets 7 come within the operative range of an aligning device to be described further below which moves the sheets 7 into contact with a lateral limiting member 6 (see FIG. 2) and a front abutment 3. This alignment takes place within the operative range of a stapling unit 19 of known design (not illustrated in etail) whose position is indicated in dash-dotted lines in FIGS. 2 and 3.

The actual aligning device according to FIG. 1 consists of a driven aligning wheel 16 which is mounted for rotation on a tube 9 in a manner not illustrated in detail.

Tube 9 is fixed to a holder 11 which is pivotable about a stationary journal 12 and is biased by a leaf spring 18 in the direciton towards stacking surface 2 in the area associated with aligning wheel 16. A spring wire 8 serving as a flexible shaft and having at its ends bent-off portions 8*b* and 8*c* is guided in tube 9. Bent-off portion 8*b* positively engages a driving portion 17 mounted for rotation on tube 9 while bent-off portion 8*c* positively engages the aligning wheel 16. Driving portion 17 is driven by a drive unit of a type known per se and not illustrated which rotates aligning wheel 16 through spring wire 8.

The front abutment 3 of collecting tray 1 is connected by arms 3*a* to a rotatably mounted shaft 5 and movable by an electromagnet (not illustrated) in the direction of the arrow "C". Also mounted to shaft 5 is a lever 4 on the free end of which a pin 4*a* is arranged which extends through a recess 6*a* of the lateral limiting member 6 and is adapted to support tube 9.

The arrangement of holder 11 for tube 9 as well as the position of arm 3*a*, lever 4 and shaft 5 can be inferred from FIGS. 2 and 3 which, as far as the mode of operation of alignment wheel 16 is concerned, related to an embodiment to be described further below which is similar to the embodiment according to FIG. 1, however, in all other respects.

Figure 2:
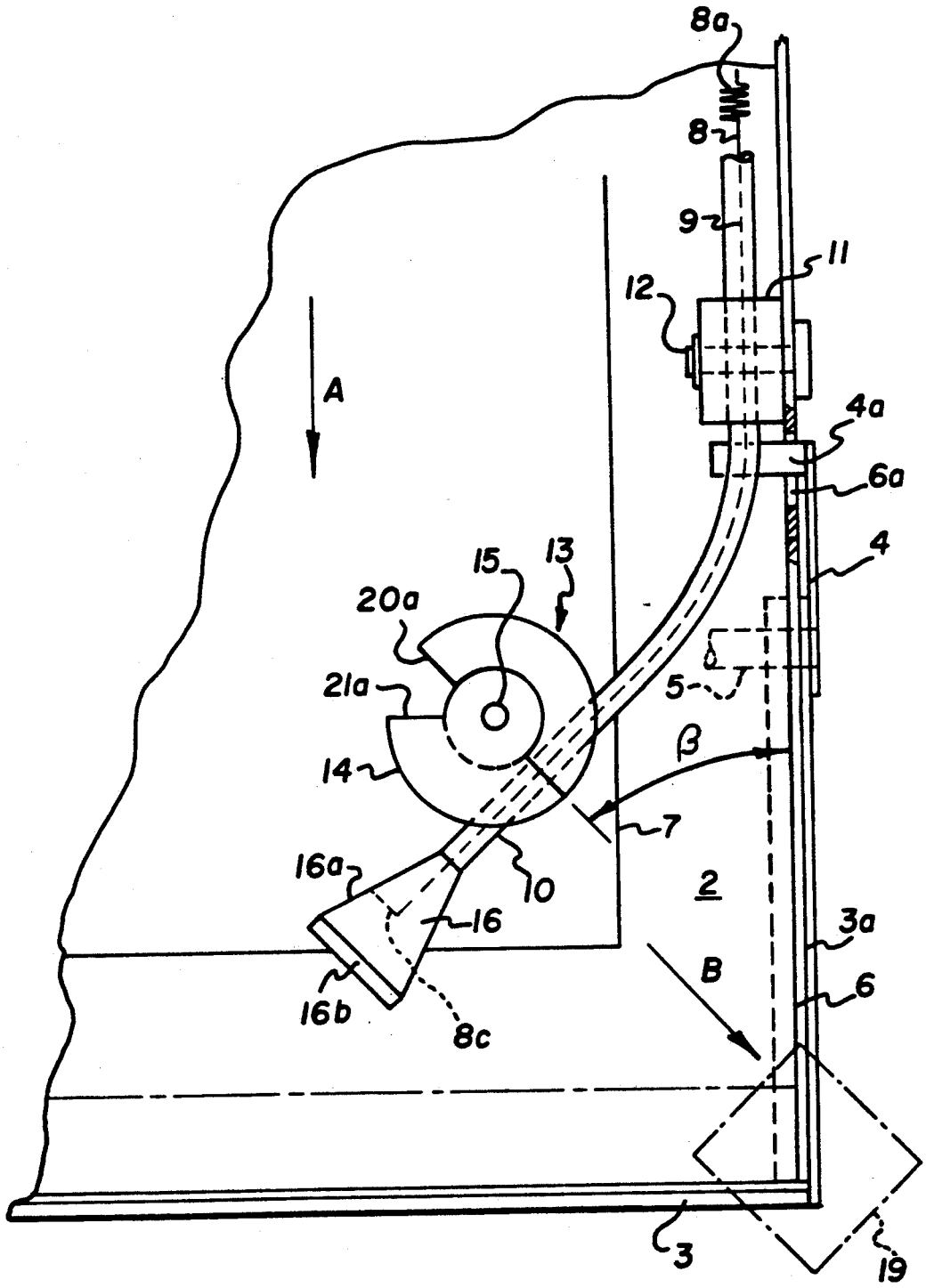
FIG. 2 is a plan view of a further embodiment of the device according to this invention.

The design of aligning wheel 16 as well as its inclined position relative to the sheet entrance direction "A", which in the case of the embodiment according to FIG. 1 cannot be changed, can be inferred in particular from FIG. 2. Alignment wheel 16 is conically shaped starting with a small diameter at the end of tube 9 and terminating with a large diameter in the circular contact surface 16*b*. The peripheral surface 16 a which faces an incoming sheet 7 arriving in the direction of the arrow "A" is disposed in an angular position such that the front end edge of an incoming sheet 7 first makes contact with the smaller diameter of peripheral surface 16*a*. The aligning wheel 16 is biased into contact with the stacking surface 2 of collecting tray 1 by a leaf spring 18 engaging tube 9.

The device according to FIG. 1 functions as follows:

A sheet 7 supplied by the copier is fed in the direction of the arrow "A" into collecting tray 1 and, under the action of gravity, moves along stacking surface 2 towards front abutment 3. During such movement the sheet is brought into the operative range of aligning wheel 16 which, as shown in FIG. 2, transports sheet 7 in the direction of the arrow "B" until it contacts the lateral limiting member 6 and the front abutment 3 and is thus aligned. Owing to the conical shape of aligning wheel 16 and the special angular position of its peripheral surface 16 a relative to the sheet entrance direction "A", which was described above, the sheets 7 are reliably guided into the range of contact surface 16*b* of aligning wheel 16. As can be inferred in particular from FIG. 1, a sheet arriving in the direction of arrow "A" is guided with its end edge along the peripheral surface 16*a*, whose diameter increases in the direction of the arrow "A", onto the surface of the stack, and thus reliably moved into the range of action of the contact surface 16*b* of aligning wheel 16. In this manner it is avoided that an incoming sheet, which initially floats at a distance from stacking surface 2, can linearly hit the aligning wheel 16 with its end edge and, as a result, slide over aligning wheel 16 and out of the range of action thereof.

The aligning wheel 16 is urged by leaf spring 18 such that it can automatically adapt itself to the height of the growing sheet stack 24. The speed of rotation of the diameters, the coefficient of friction of contact surface 16*b* of the aligning wheel 16 and its spring urging are chosen and/or adapted to each other such that aligning wheel 16, 16*b* slides and slips over each uppermost sheet as soon as such sheet has reached its end position in which it is aligned on the lateral limiting member 6 and the front abutment 3 without the sheets being compressed thereby. After the desired number of sheets has entered collecting tray 1, stapling unit 19 is activated for stapling the sheet stack 24.

After stapling, abutment 3 is electromagnetically driven to pivot in the direction of the arrow "C" while tube 9 is simultaneously pivoted clockwise via lever 4 connected with the abutment and via pin 4*a* so that the aligning wheel 16 is lifted off sheet stack 24. The stapled sheet stack 24 is thus released and, under the action of gravity, can slide unimpededly along stacking surface 2 in the direction of the arrow "A" out of collecting tray 1 and in orderly alignment into a depositing tray arranged downstream and not illustrated. When the stapled sheet stack has left collecting tray 1, abutment 3 is returned to its closing position shown in FIG. 1. During such movement the spring-biased tube 9 is disengaged via ever 4 and its pin 4*a* respectively so that aligning wheel 16 can resume its operative position illustrated.

In the case of the embodiment according to FIG. 1, stacking surface 2 of collecting tray 1 is inclined as described such that the incoming sheets can drop by their own weight into a position at the front abutment 3 so that they have to be aligned substantially on the lateral limiting member 6 only. For this reason aligning wheel 16 may be arranged very close to the front abutment 3, as can been seen in FIG. 1. However, if in contrast to that embodiment the collecting tray 1 is arranged at a less acute angle $\alpha$ (see for example FIG. 5), it has to be seen to it that the sheets are additionally transported in the direction of the arrow "A". Moreover, aligning wheel 16 must be arranged at a slightly greater distance from front abutment 3 in order that the incoming sheets can always be moved into the range of action of aligning wheel 16.

Figure 3:
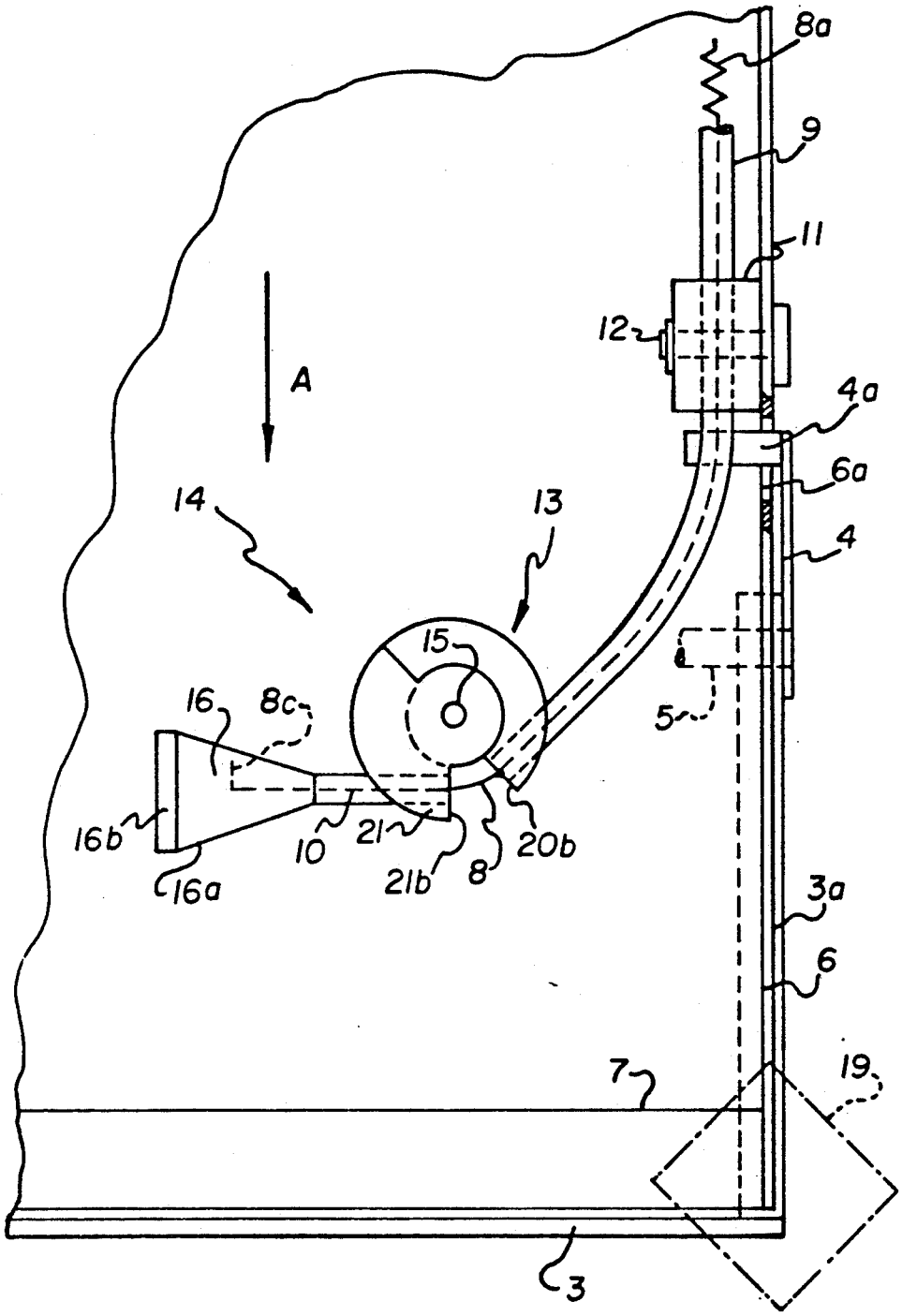
FIG. 3 shows the device according to FIG. 2 with its operative direction changed.
Figure 4:
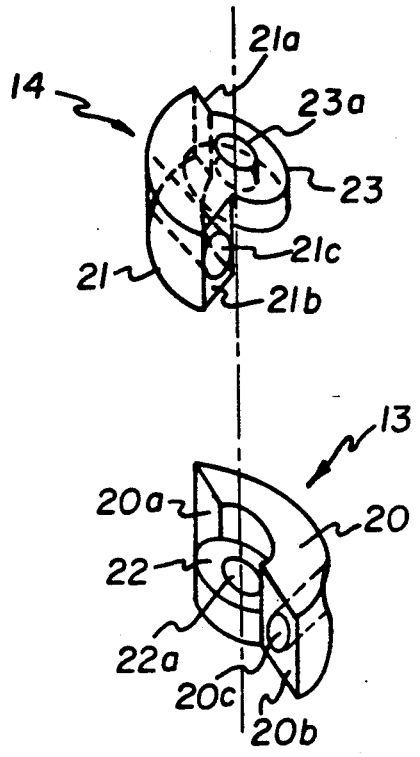
FIG. 4 is an exploded oblique partial view of the pivotal support.

With reference to FIGS. 2 to 4, a corresponding embodiment will now be described, which in contrast to the embodiment according to FIG. 1 is provided with an aligning wheel 16 which is pivotable in different operative directions. For this purpose the area of tube 9 associated with aligning wheel 16 is divided into two sections (9 and 10) which are secured to a support which consists of two components 13, 14. The longer tube 9 terminates in the first component 13 of the support, which is stationarily mounted. The second component 14 is arranged on the first component 13 so as to be pivotable about a journal 15. Mounted to the second component 14 is a short tube 10 on which the aligning-wheel 16 is mounted for rotation. The two tubes 9 and 10 within which spring wire 8 is guided are aligned with each other as is shown in FIG. 2.

As can be seen in particular in FIG. 4, both components 13 and 14 are each provided with a circular ring section 20 and 21 respectively whose end faces defining the arcuate length are denoted 20*a* and 20*b* and 21*a* and 21*b* respectively. Each component 13 and 14 respectively has a mounting flange 22 and 23 respectively provided with a bore 22*a* and 23*a* respectively and forming an integral unit with its circular ring section 20 and 21 respectively, the circular ring sections 20 and 21 being twice as broad as the mounting flanges 22 and 23 in the axial direction. The circular ring sections 20 and 21 as well as the mounting flanges 22 and 23 are arranged concentrically with the bores 22*a* and 23*a* respectively and the mounting flanges 22 and 23 respectively and have identical diameters so that the similar components 13, 14 can be connected via journal 15 (not illustrated in detail) to form a compact support as shown in FIGS. 2 and 3. The circular ring section 20 of component 13 has an arcuate length of 180° while the circular ring section 21 of component 14 has an arcuate length of 135° so that component 14 can carry out a pivotal movement over a distance of 45°. The end faces 20*a* and 20*b* of the stationary component 13 form an angle $\beta$ of 45° with the lateral limiting member 6, as can be seen in FIGS. 2 and 3, which defines the initial position of component 14, as illustrated in FIG. 2, and thus the operative direction "B" of aligning wheel 16.

The tubes 9 and 10 are mounted in bores 20*c* and 21*c* respectively which extend vertically to the end faces 20*b* and 21*b* respectively of the components 13 and 14 respectively and, as shown in FIG. 2, are in alignment with each other. The aligning wheel 16 is driven by the spring wire 8 which functions as a flexible shaft whose bent-off portion 8*c* positively engages aligning wheel 16 and which is driven in a manner analogous to that described in connection with FIG. 1. In some areas spring wire 8 is designed as a helical tension spring 8*a* which allows for length compensation of spring wire 8 when component 14 is pivoted between the positions according to FIGS. 2 and 3.

The device according to FIGS. 2 and 4 functions as follows:

A sheet 7 arriving in the direction of the arrow "A" is moved in the direction of the arrow "B" into contact with the lateral limiting member 6 by the aligning wheel 16 shown in its initial position in FIG. 2. As soon as sheet 7 rests against the lateral limiting member 6 (end side position of sheet 7 shown in dash-dotted lines in FIG. 2) aligning wheel 16 is not capable of any further transport action in the direction of the arrow "B". Due to the increasing friction within the operative range of aligning wheel 16, 16*b*, the wheel rotates on sheet 7 from the position shown in FIG. 2 to the position shown in FIG. 3 in which the end faces 20*a*, 21*a* of the components 13, 14 rest against each other. During the pivotal movement of component 14, tension spring 8*a* which serves for length compensation and as a resetting spring is tensioned .

The aligning wheel 16 which is now operative in the sheet entrance direction "A" transports sheet 7 in its laterally aligned position to its position on front abutment 3 and, when the front alignment-. position has been reached, slips over the sheet now arrested as was described in connection with FIG. 1. The speed of rotation, the diameter, the coefficient of friction of the contact surface 16*b* of aligning wheel 16, the load of leaf spring 18 and the spring force of the tension spring section 8*a* of spring wire 8 are chosen and/or adapted to each other such that aligning wheel 16 reliably aligns each uppermost sheet laterally and at its end side respectively and, when the aligned position has been reached, slips over the sheet without the sheet being compressed. As soon as the next sheet enters the range of action of aligning wheel 16, the wheel can carry out another transport movement in the direction towards the lateral limiting member 6. For this purpose it is reset by tension spring 8*a* to its initial position according to FIG. 2 in which the end faces 20*b* and 21*b* of the components 13 and 14 rest against each other whereupon the next aligning cycle starts as was described before.

The change in the operative direction from "B" according to FIG. 2 to "A" according to FIG. 3 is continuous so that an alignment with the lateral limiting member 6 is always ensured. The operative directions "A" and/or "B" of the aligning wheel 16 which are given by way of example, can also form a different angle with the lateral limiting member 6 depending on what is useful in a particular case. In contrast to the position shown in FIG. 3 the aligning wheel 16 can be positioned, for example, such that it is directed at an angle of 5° to the lateral limiting member 6 (not illustrated) so that a force component is in all cases operative in the direction of the arrow "B" and the sheets are thus reliably held in their aligned- position on the lateral limiting member 6.

Figure 5:
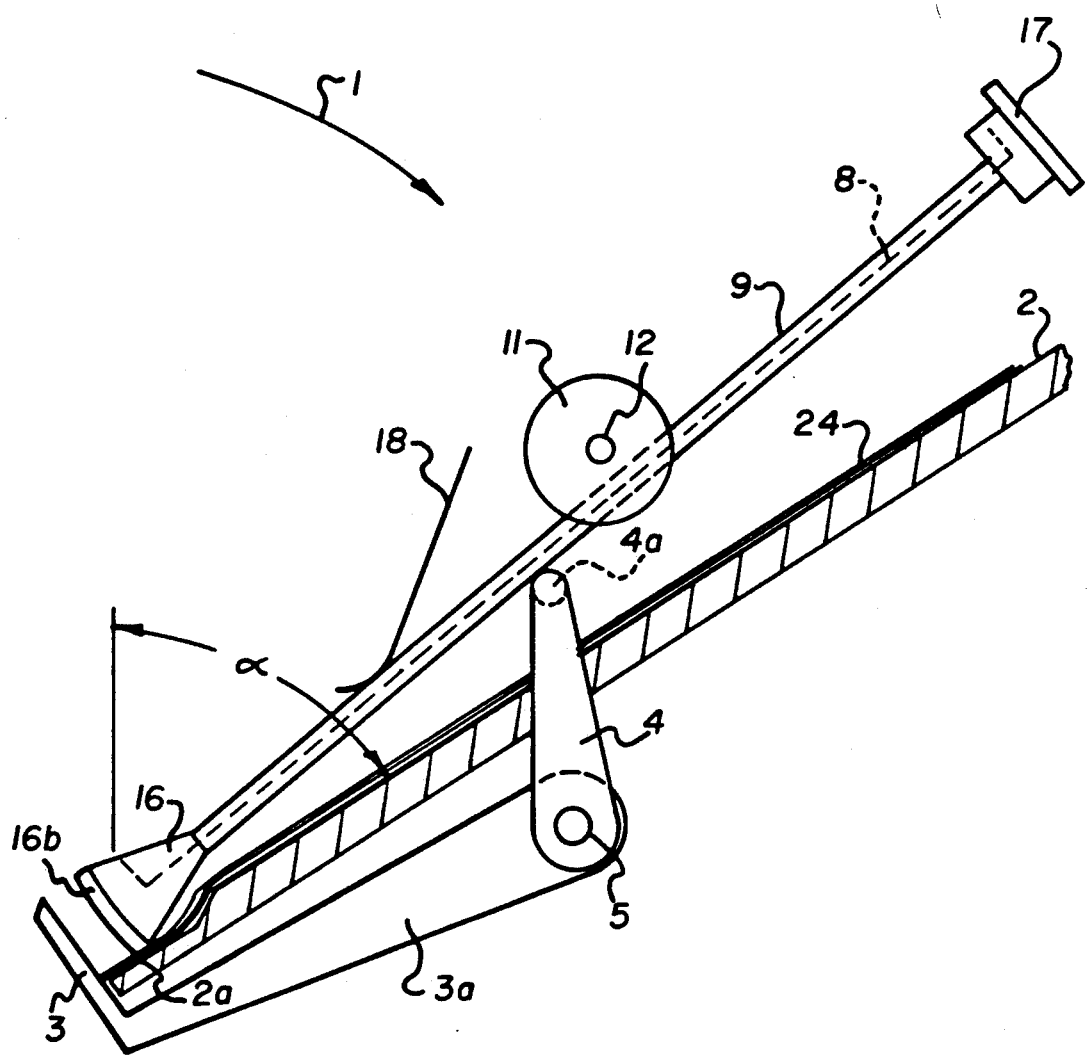
FIG. 5 is a lateral, partially sectional view of a further embodiment of the device according to this invention.

As a result of the mode of functioning of aligning wheel 16 according to FIG. 3, sheet 7 is also reliably and speedily transported to the front abutment 3 if the stacking surface 2 is less steeply disposed, e.g. in the way illustrated in FIG. 5. After the desired number of sheets has been deposited in collecting tray 1, sheet stack 24 is stapled by stapling unit 19 and released by front abutment 3 pivoting to its open position and alignment wheel 16 being lifted at the same time as was described in connection with FIG. 1. Depending on the angular position of stacking surface 2 of collecting tray 1 the stapled sheet stack either slides automatically into a depositing tray under the action of gravity or, as was described before, is fed out in the direction of the arrow "A" by transport rollers or belts known per se and not illustrated which can be pivoted towards the sheet stack from below. In either case, the stapled sheet stack 24 is removed without hindrance by the aligning wheel 16 which continues rotating but is lifted so that the stack can slide in proper alignment into a depositing tray arranged downstream and not illustrated. The proper alignment of the stapled sheet stack 24 leaving collecting tray 1 is also useful if the completed sheet stack is first engaged by further transport means and then deposited (not illustrated).

In the case of further embodiment illustrated in FIG. 5, the stacking surface 2 of collecting tray 1 is provided with a surface section 2*a* which is arranged in the front area associated with front abutment 3, extends parallel with the abutment and with the stacking surface 2 and is disposed on a lower plane. This enables an incoming sheet to be deformed by the aligning wheel 16 so that it becomes S-shaped and is transversely stiffened. Thin and/or curved sheets are thus stiffened to such an extent that they cannot slide over the lateral limiting member 6 or the abutment 3 but are reliably aligned. The sheets can become curved when passing through a copier under the influence of heat, pressure and static charges. In contrast to the design of the components 13 and 14 respectively illustrated in FIGS. 2 to 4, these components can be identically designed in a particularly advantageous manner (not illustrated). The arcuate length of such identical components is 157.5° so that the pivotal component 14 can also pivot over a path of 45° as was described in connection with FIGS. 2 and 3.

The above description and the drawings are confined to features which are essential to the invention. Those features which are disclosed in the description and in the drawings but are not mentioned in the claims also serve for defining the subject matter of the invention, if required.

I claim:

1. Device for aligning sheets which are individually supplied to, and stacked in a collecting tray, having a stacking surface and a lateral limiting member extending parallel with the sheet entrance direction as well as an abutment associated with the front end sides of the sheets said device comprising:

a drivable aligning wheel (16) which rests on an incoming sheet and aligns said sheet with both said lateral limiting member and said front abutment (3), said front abutment (3) movable out of the transport path of sheet stack (7), said aligning wheel (16) liftable off the sheet stack (24) and said abutment (3) and aligning wheel (16) being positively coupled such that when said abutment (3) is moved out of the transport path, said aligning wheel (16) is also lifted off the sheet stack (24).

2. Device for aligning sheets which are individually supplied to, and stacked in a collecting tray having a stacking surface and a lateral limiting member extending parallel with the sheet entrance direction as well as an abutment associated with the front end sides of said sheets, said device comprising:

a drivable aligning wheel which rests on an incoming sheet and aligns such sheet with both the lateral limiting member and the front abutment, said aligning wheel (16) being conically shaped and having a diameter which increases in the direction from said lateral limiting member (6) towards the center of the incoming sheet, and the peripheral conical surface (16*a*) of the aligning wheel (16), which serves as a guiding surface, being arranged at an angle to the sheet entrance direction "A" such that the smaller diameter of said aligning wheel (16) is closest to the incoming sheet (7).

3. The device for aligning sheets according to claim 2 wherein said aligning wheel (16) is arranged on a pivotable support (13, 14) spring urged in the direction towards the lateral limiting member (6), the contact surface (16*b*) of said aligning wheel (16), which rests on the incoming sheet (7) being arranged at an angle ($\beta$) to the lateral limiting member (6), and when friction increases due to the sheet (7) resting against said lateral limiting member (6), said aligning wheel (16) is pivoted in opposition to the spring urging on support (14) to move to a position in which it is operative in the sheet entrance direction "A".

4. The device for aligning sheets according to claim 3 wherein said support includes a first, stationarily mounted component (13) and a second component (14) which is pivotally mounted on said first component and movable within a positively defined path of pivotal movement.

5. The device for aligning sheets according to claim 4 wherein said first and second components (13 and 14 respectively) each has a mounting flange (22 and 23 respectively) provided with a bore (22*a* and 23*a* respectively) and an integrally formed circular ring section (20 and 21 respectively) which is concentric with bore (22*a* and 23*a* respectively), and said first and second components (13, 14) are rotatably connected via a Journal (15) engaging said bores (22*a*, 23*a*) such that the end faces (20*a*, 21*a* and 20*b*, 21*b* respectively) defining the arcuate lengths of said circular ring sections (20, 21) form opposing abutments which are operative in two directions.

6. The device for alignging sheets according to claim 5 wherein said circular ring sections (20, 21) are twice as broad as said mounting flanges (22, 23) in the axial direction.

7. The device for aligning sheets according to claim 6 wherein said aligning wheel (16) is mounted for rotation on said pivotably mounted component (14).

8. The device for aligning sheets according to claim 7 wherein said aligning wheel (16) is mounted for rotation on a small tube (10) secured to the pivotably mounted component (14), a long tube (9) aligned with said small tube (10) in the area of the end faces (20*b*, 21*b*) of the said first and second components (132, 14) is connected to the stationarily mounted first component (13), a spring wire (8) is guided in said small and long tubes, said spring wire serving as a flexible shaft whose ends (8*b*, 8*c*) positively engage said aligning wheel (16) and a driving portion (17) respectively, and for length compensation, said spring wire (8) is in some areas a helical tension spring (8*a*).

9. The device for aligning sheets according to claim 8 wherein said long tube (9) is mounted on a pivotable, stationarily mounted holder (11).

10. The device for aligning sheets according to claim 9 wherein said front abutment (3) is pivotably mounted to an arm (3*a*), said arm (3*a*) being connected with a level (4) carrying at its free end a pin (4*a*) for supporting said long tube (9).

11. The device for aligning sheets according to claim 10 wherein said stacking surface (2) of said collecting tray (1) is downwardly inclined to the sheet entrance direction (A).

12. The device for aligning sheets according to claim 11 wherein the area of stacking surface (2) that is associated with the range of action of said aligning wheel (16) has a lower section (2*a*) which is parallel with front said abutment (3) and with said stacking surface (2) and serves to stabilize the end sections of the sheets by deformation.

13. The device for aligning sheets according to claim 12 wherein said first and second components (13, 14) are substantially identical.

* * * * *